US007529523B1

(12) United States Patent
Young et al.

(10) Patent No.: US 7,529,523 B1
(45) Date of Patent: May 5, 2009

(54) N-TH ORDER CURVE FIT FOR POWER CALIBRATION IN A MOBILE TERMINAL

(75) Inventors: Jason Young, Palm City, FL (US); Dennis Mahoney, High Point, NC (US); Ricke W. Clark, Irvine, CA (US); Nadim Khlat, Midi-Pyrenees (FR); Adam Toner, Kernersville, NC (US)

(73) Assignee: RF Micro Devices, Inc., Greensboro, NC (US)

( * ) Notice: Subject to any disclaimer, the term of this patent is extended or adjusted under 35 U.S.C. 154(b) by 763 days.

(21) Appl. No.: 11/209,435

(22) Filed: Aug. 23, 2005

Related U.S. Application Data

(60) Provisional application No. 60/603,709, filed on Aug. 23, 2004.

(51) Int. Cl.
*H01Q 11/12* (2006.01)

(52) U.S. Cl. ..... 455/115.1; 455/127.2; 330/2

(58) Field of Classification Search ..... None
See application file for complete search history.

(56) References Cited

U.S. PATENT DOCUMENTS

| | | | |
|---|---|---|---|
| 3,900,823 | A | 8/1975 | Sokal et al. |
| 4,609,881 | A | 9/1986 | Wells |
| 4,837,786 | A | 6/1989 | Gurantz et al. |
| 5,055,802 | A | 10/1991 | Hietala et al. |
| 5,079,522 | A | 1/1992 | Owen et al. |
| 5,313,411 | A | 5/1994 | Tsujimoto |
| 5,430,416 | A | 7/1995 | Black et al. |
| 5,444,415 | A | 8/1995 | Dent et al. |
| 5,598,436 | A | 1/1997 | Brajal et al. |
| 5,608,353 | A | 3/1997 | Pratt |
| 5,629,648 | A | 5/1997 | Pratt |
| 5,822,011 | A | 10/1998 | Rumreich |
| 5,900,778 | A | 5/1999 | Stonick et al. |
| 5,952,895 | A | 9/1999 | McCune, Jr. et al. |
| 6,008,703 | A | 12/1999 | Perrott et al. |
| 6,101,224 | A | 8/2000 | Lindoff et al. |

(Continued)

OTHER PUBLICATIONS

Andraka, Ray, "A Survey of CORDIC Algorithms for FPGA Based Computers," Association for Computing Machinery, 0-89791-978-5, 1998.

(Continued)

*Primary Examiner*—Thanh C Le
(74) *Attorney, Agent, or Firm*—Withrow & Terranova, P.L.L.C.

(57) ABSTRACT

A method for calibrating the output power of a mobile terminal using at least a second order curve fit to describe a power amplifier gain (PAG) setting versus output power characteristic of a power amplifier in a transmitter of the mobile terminal is provided. For each of an upper-band frequency, a mid-band frequency, and a lower-band frequency of a frequency band, multiple measurements of the output power of the mobile terminal are made corresponding to multiple values of the PAG setting, and a curve fit is performed, thereby calculating coefficients defining a polynomial describing the PAG setting versus output power characteristic. Using the polynomials describing the PAG setting versus output power characteristic of the power amplifier for each of the upper-band, mid-band, and lower-band frequencies, values of the PAG setting are determined for each desired output power level for each desired frequency within the frequency band.

21 Claims, 8 Drawing Sheets

U.S. PATENT DOCUMENTS 6,130,579 A 10/2000 Iyer et al.
6,141,390 A 10/2000 Cova
6,191,656 B1 2/2001 Nadler
6,211,747 B1 4/2001 Trichet et al.
6,229,395 B1 5/2001 Kay
6,236,687 B1 5/2001 Caso et al.
6,236,703 B1 5/2001 Riley
6,240,278 B1 5/2001 Midya et al.
6,246,286 B1 6/2001 Persson
6,271,727 B1 8/2001 Schmukler
6,275,685 B1 8/2001 Wessel et al.
6,285,239 B1 9/2001 Iyer et al.
6,288,610 B1 9/2001 Miyashita
6,295,442 B1 9/2001 Camp, Jr. et al.
6,307,364 B1 10/2001 Augustine
6,329,809 B1 12/2001 Dening et al.
6,335,767 B1 1/2002 Twitchell et al.
6,356,150 B1 3/2002 Spears et al.
6,359,950 B2 3/2002 Gossmann et al.
6,366,177 B1 4/2002 McCune et al.
6,377,784 B2 4/2002 McCune
6,392,487 B1 5/2002 Alexanian
6,417,731 B1 7/2002 Funada et al.
6,489,846 B2 12/2002 Hatsugai
6,504,885 B1 1/2003 Chen
6,522,121 B2 2/2003 Coumou
6,581,082 B1 6/2003 Opsahl
6,587,514 B1 7/2003 Wright et al.
6,642,786 B1 11/2003 Jin et al.
6,693,468 B2 2/2004 Humphreys et al.
6,700,929 B1 3/2004 Shan et al.
6,701,134 B1 3/2004 Epperson
6,701,138 B2 3/2004 Epperson et al.
6,720,831 B2 4/2004 Dening et al.
6,724,252 B2 4/2004 Ngo et al.
6,724,265 B2 4/2004 Humphreys
6,724,831 B1 4/2004 Hasegawa et al.
6,728,324 B1 4/2004 Shan et al.
6,731,145 B1 5/2004 Humphreys et al.
6,748,204 B1 6/2004 Razavi et al.
6,782,244 B2 8/2004 Steel et al.
6,798,843 B1 9/2004 Wright et al.
6,801,086 B1 10/2004 Chandrasekaran
6,807,406 B1 10/2004 Razavi et al.
6,816,718 B2 11/2004 Yan et al.
6,819,914 B2 11/2004 Yan et al.
6,819,941 B2 11/2004 Dening et al.
6,831,506 B1 12/2004 Moffat et al.
6,834,084 B2 12/2004 Hietala
6,836,517 B2 12/2004 Nagatani et al.
6,900,778 B1 5/2005 Yamamoto
6,914,943 B2 7/2005 Shimizu
6,975,688 B2 12/2005 Rexberg et al.
7,010,276 B2 3/2006 Sander et al.
7,054,385 B2 5/2006 Booth et al.
7,109,791 B1 9/2006 Epperson et al.
7,113,036 B2 9/2006 Moffatt et al.
7,158,494 B2 1/2007 Sander et al.
7,349,490 B2 3/2008 Hunton
2001/0033238 A1 10/2001 Velazquez
2002/0008578 A1 1/2002 Wright et al.
2002/0041210 A1 4/2002 Booth et al.
2002/0060606 A1 5/2002 Andre
2002/0093378 A1 7/2002 Nielsen et al.
2002/0160821 A1 10/2002 Kaikati et al.
2003/0012289 A1 1/2003 Lindoff
2003/0133518 A1 7/2003 Koomullil et al.
2003/0179830 A1 9/2003 Eidson et al.
2003/0197558 A1 10/2003 Bauder et al.
2003/0215025 A1 11/2003 Hietala
2003/0215026 A1 11/2003 Hietala
2003/0227342 A1 12/2003 Liu
2004/0072597 A1 4/2004 Epperson et al.
2004/0183511 A1 9/2004 Dening
2004/0198414 A1 10/2004 Hunton
2004/0208157 A1 10/2004 Sander et al.
2005/0002470 A1 1/2005 Saed et al.
2005/0059361 A1* 3/2005 Shi et al. ..... 455/115.1
2005/0195919 A1 9/2005 Cova
2006/0071711 A1 4/2006 Persson et al.
2006/0189285 A1* 8/2006 Takano et al. ..... 455/127.2
2007/0001756 A1* 1/2007 Trocke et al. ..... 330/2

OTHER PUBLICATIONS

Johnson, Jackie, "Power Amplifier Design for Open Loop EDGE Large Signal Polar Modulation Systems," RFDesign, Jun. 2006, pp. 42-50.

Pinto et al., "Phase Distortion and Error Vector Magnitude for 8-PSK Systems," London Communications Symposium, Sep. 14-15, 2000, University College London, London, England.

Volder, Jack E., "The CORDIC Trigonometric Computing Technique," IRE Trans. On Elect. Computers p. 330, Sep. 1959.

* cited by examiner

N-TH ORDER CURVE FIT FOR POWER CALIBRATION IN A MOBILE TERMINAL

RELATED APPLICATIONS

This U.S. patent application claims the benefit of provisional patent application Ser. No. 60/603,709, filed Aug. 23, 2004, the disclosure of which is hereby incorporated by reference in its entirety.

FIELD OF THE INVENTION

The present invention relates to a method of calibrating an output power of a mobile terminal using an N-th order curve fit for an output voltage versus input voltage characteristic of the power amplifier.

BACKGROUND OF THE INVENTION

One standard for mobile telephone communications is the Global System for Mobile Communications (GSM) standard. The GSM standard covers four large frequency bands and requires the mobile telephone to operate between 14 and 16 specific power levels in each of the frequency bands. With an open-loop transmitter, a large number of frequency bands, and so many power levels, individually calibrating the output power of the mobile telephone for each power level within each frequency band is costly. Accordingly, it is desirable to use a power calibration technique that uses a small number of measurements to calibrate the output power of the mobile telephone for each frequency band.

Many GSM mobile telephones use an analog control voltage to control the gain of a power amplifier in the transmit chain of the mobile telephone, and thus the output power. Historically, an output power versus control voltage characteristic of the power amplifier is assumed to be linear. Thus, for each frequency band, the output power is calibrated by measuring the output power at two power levels and using a first order curve fit to predict the output power versus control voltage characteristic of the power amplifier for all output power levels. The linear assumption introduces errors in output power accuracy that may be considered unacceptable. Thus, there remains a need for a more accurate power calibration technique that uses a small number of measurements to calibrate the output power of the mobile telephone for each frequency band.

SUMMARY OF THE INVENTION

The present invention provides a method for calibrating the output power of a mobile terminal using at least a second order curve fit to describe a power amplifier gain (PAG) setting versus output power characteristic of a power amplifier in a transmit chain of the mobile terminal. In general, for each of an upper-band frequency, a mid-band frequency, and a lower-band frequency of a desired frequency band, multiple measurements of the output power of the mobile terminal are made for corresponding values of the PAG setting, and a curve fit is performed. Using the measurements of the output power, coefficients are determined that define polynomials describing the PAG setting versus output power characteristic for each of an upper-band frequency, a mid-band frequency, and a lower-band frequency of a desired frequency band. Values of the PAG setting corresponding to multiple desired output power levels for multiple frequencies within the desired frequency band are determined based on the polynomials describing the PAG setting versus output power characteristic of the power amplifier for each of the upper-band, mid-band, and lower-band frequencies of the desired frequency band.

In one embodiment, the mobile terminal is a Global System for Mobile Communication (GSM) mobile telephone, and the polynomials describing the PAG setting versus output power characteristic of the power amplifier for each of the upper-band, mid-band, and lower-band frequencies of the desired frequency band are determined while the mobile terminal is operating in a Gaussian Minimum Shift Keying (GMSK) mode of operation. The polynomials may also be used to calibrate the output power of the mobile terminal for an Enhanced Data Rate for Global Evolution (EDGE) mode of operation, which may also be referred to as an 8-Level Phase Shift Keying (8PSK) mode of operation.

Those skilled in the art will appreciate the scope of the present invention and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the invention, and together with the description serve to explain the principles of the invention.

Figure 4A:
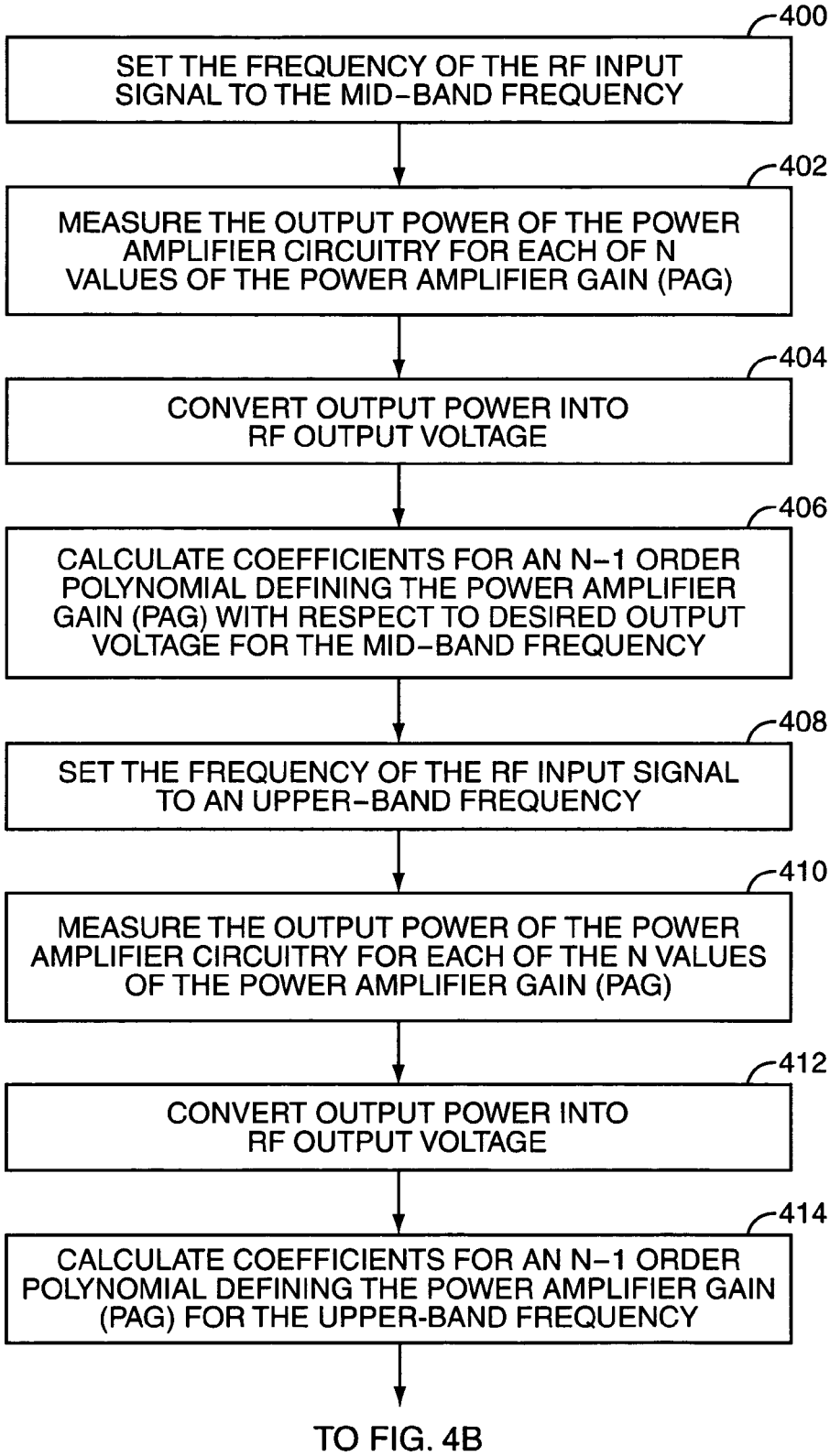
FIGS. 4A-4B illustrate a method of calibrating the output power of the mobile terminal of FIGS. 1 and 2 for GMSK mode according to another embodiment of the present invention.
Figure 4B:
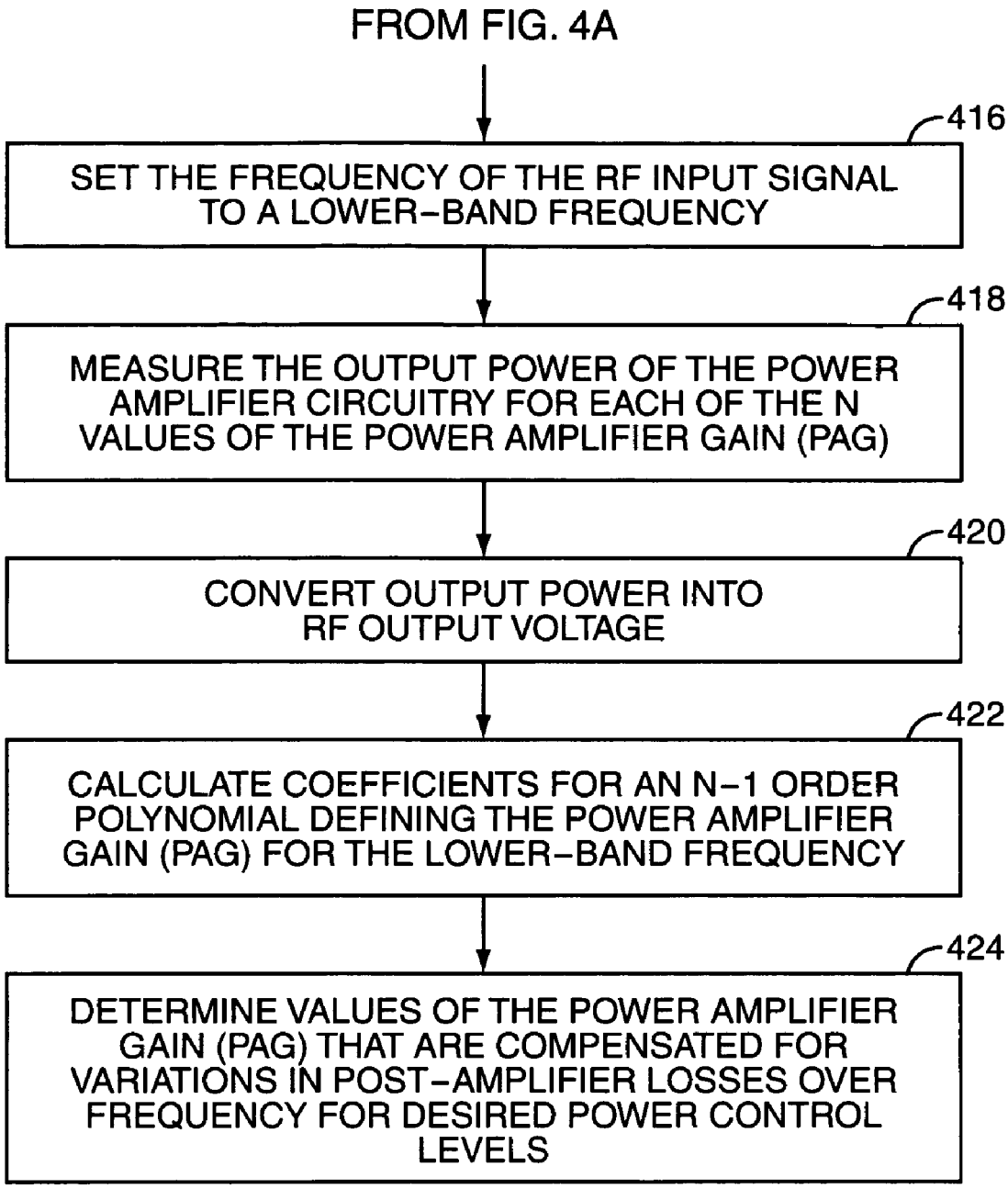
Figure 5:
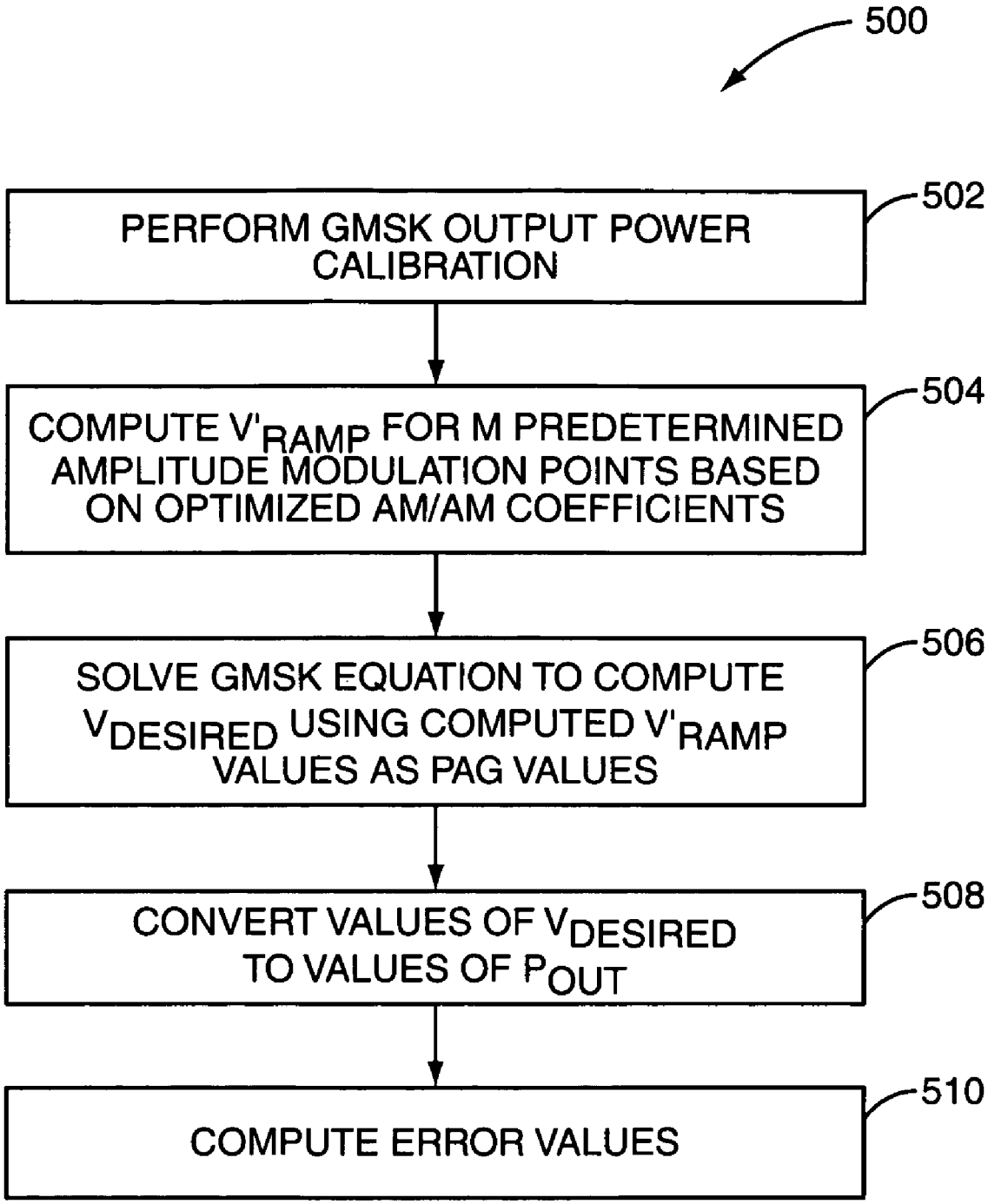
FIG. 5 illustrates a method of calculating output power error values for numerous predetermined amplitude modulation points for EDGE mode in a reference mobile terminal.
Figure 6:
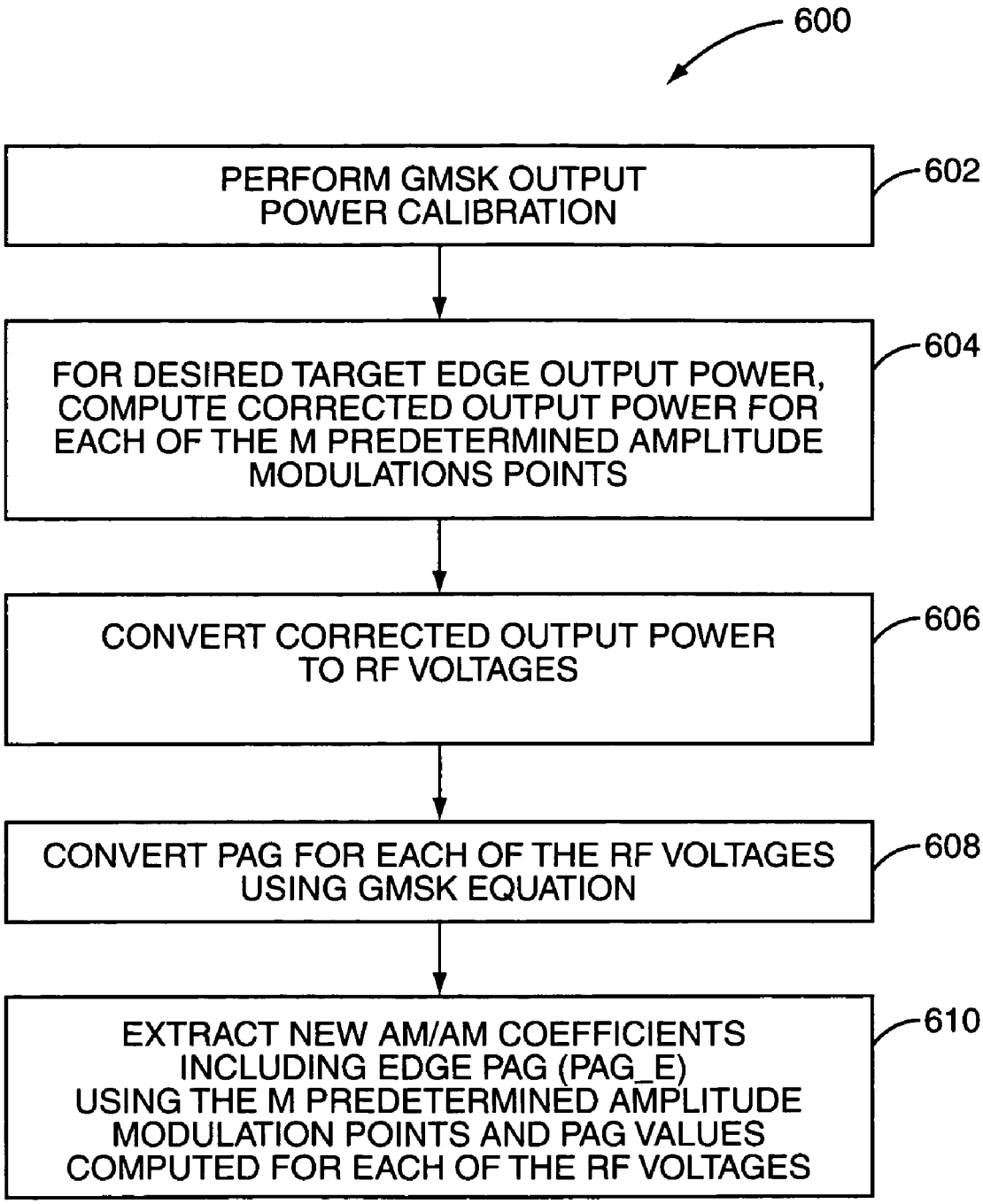
Figure 7:
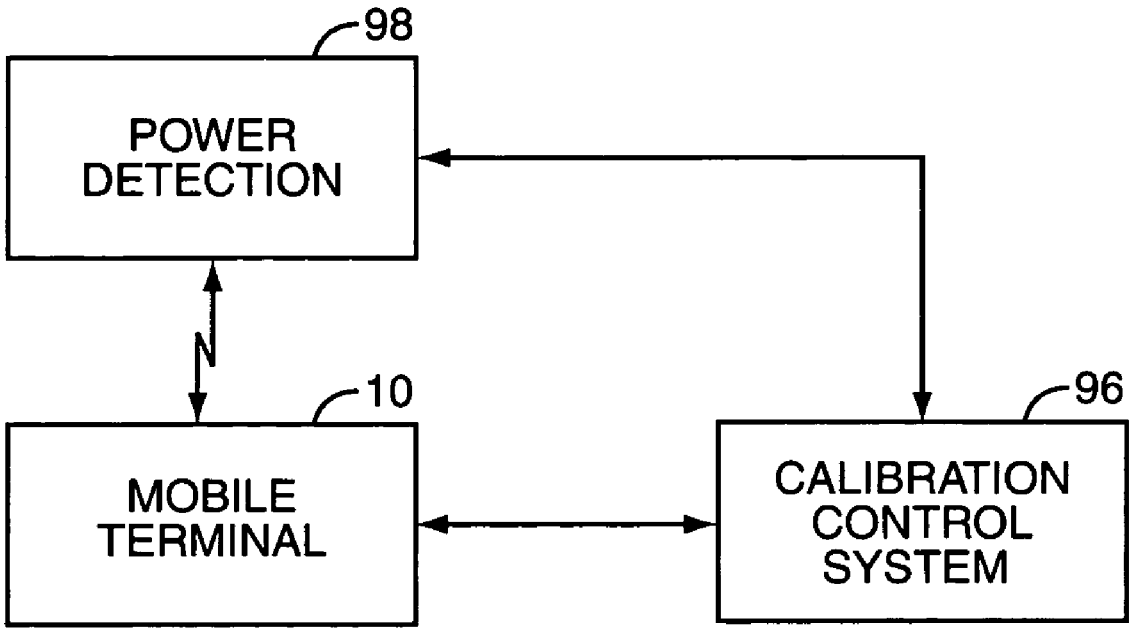

FIG. 6 illustrates a method of calibrating the output power and Amplitude Modulation to Amplitude Modulation (AM/AM) predistortion including a power amplifier gain of the mobile terminal for EDGE mode based on the error values determined in the method of FIG. 5; and FIG. 7 illustrates an output power calibration system for calibrating the output power of a mobile terminal according to the methods of FIGS. 3-6.

DETAILED DESCRIPTION OF THE PREFERRED EMBODIMENTS

The embodiments set forth below represent the necessary information to enable those skilled in the art to practice the invention and illustrate the best mode of practicing the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Figure 1:
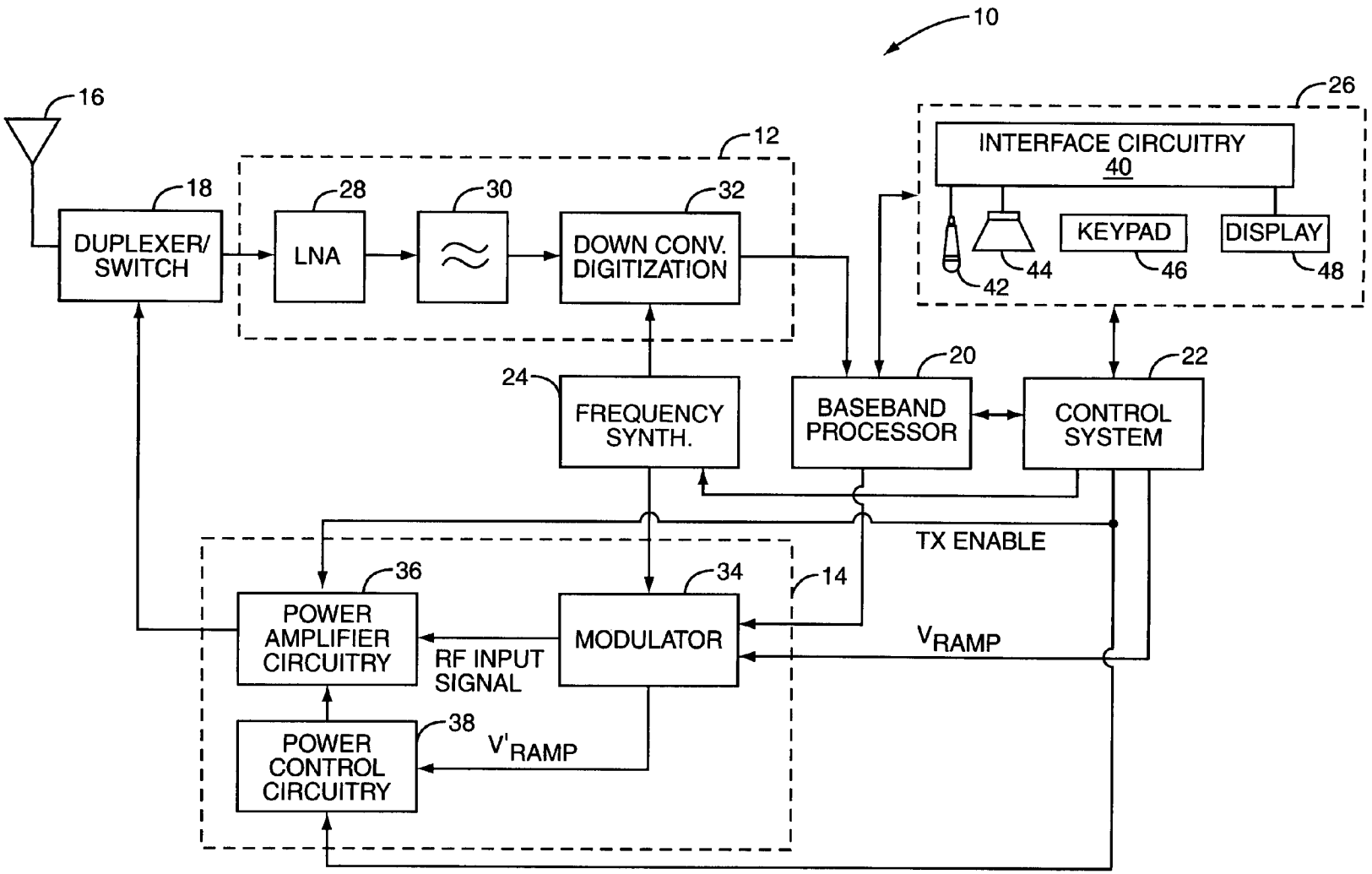
FIG. 1 is a general block diagram of an exemplary mobile terminal.

The present invention provides a method for calibrating an output power of a mobile terminal using a second order or higher curve fit to define a polynomial describing a power amplifier gain (PAG) setting versus output power characteristic of a power amplifier in a transmit chain of the mobile terminal. The basic architecture of a mobile terminal 10 is represented in FIG. 1 and may include a receiver front end 12, a radio frequency transmitter section 14, an antenna 16, a duplexer or switch 18, a baseband processor 20, a control system 22, a frequency synthesizer 24, and an interface 26. The receiver front end 12 receives information bearing radio frequency signals from one or more remote transmitters provided by a base station. A low noise amplifier 28 amplifies the signal. A filter circuit 30 minimizes broadband interference in the received signal, while downconversion and digitization circuitry 32 downconverts the filtered, received signal to an intermediate or baseband frequency signal, and then digitizes the intermediate or baseband frequency signal into one or more digital streams. The receiver front end 12 typically uses one or more mixing frequencies generated by the frequency synthesizer 24.

The baseband processor 20 processes the digitized received signal to extract the information or data bits conveyed in the received signal. This processing typically comprises demodulation, decoding, and error correction operations. As such, the baseband processor 20 is generally implemented in one or more digital signal processors (DSPs).

On the transmit side, the baseband processor 20 receives digitized data from the control system 22, which it encodes for transmission. The encoded data is output to the radio frequency transmitter section 14, where it is used by a modulator 34 to modulate a carrier signal that is at a desired transmit frequency. Power amplifier circuitry 36 amplifies the modulated carrier signal to a level appropriate for transmission from the antenna 16.

The power amplifier circuitry 36 provides gain for the signal to be transmitted under control of power control circuitry 38, which is preferably controlled by a power control signal ($V'_{RAMP}$) provided by the modulator 34 based on an adjustable power control signal ($V_{RAMP}$) from the control system 22. In one embodiment, the adjustable power control signal ($V_{RAMP}$) is a digital signal and the power control signal ($V'_{RAMP}$) is an analog signal. However, the adjustable power control signal ($V_{RAMP}$) may alternatively be an analog signal. The control system 22 generates the adjustable power control signal ($V_{RAMP}$) based on combining a power amplifier gain (PAG) corresponding to a desired output power level and a ramping function. The ramping function has a shape defined by a burst mask specification of the mobile terminal 10. For example, for a GSM telephone, the burst mask specification defines the rise time, fall time, and duration of the ramping function. In one embodiment, the adjustable power control signal ($V_{RAMP}$) is generated by multiplying the power amplifier gain (PAG) and the ramping function. Alternatively, the control system 22 may provide the PAG value to the modulator 34, and the ramping function may be generated and combined with the PAG value within the modulator 34. The control system 22 may also provide a transmit enable signal (TX ENABLE) to effectively turn the power amplifier circuitry 36 and power control circuitry 38 on during periods of transmission.

A user may interact with the mobile terminal 10 via the interface 26, which may include interface circuitry 40 associated with a microphone 42, a speaker 44, a keypad 46, and a display 48. The interface circuitry 40 typically includes analog-to-digital converters, digital-to-analog converters, amplifiers, and the like. Additionally, it may include a voice encoder/decoder, in which case it may communicate directly with the baseband processor 20.

The microphone 42 will typically convert audio input, such as the user's voice, into an electrical signal, which is then digitized and passed directly or indirectly to the baseband processor 20. Audio information encoded in the received signal is recovered by the baseband processor 20, and converted into an analog signal suitable for driving the speaker 44 by the I/O and interface circuitry 40. The keypad 46 and display 48 enable the user to interact with the mobile terminal 10, input numbers to be dialed and address book information, or the like, as well as monitor call progress information.

Exemplary embodiments of the power amplifier circuitry 36 and the power control circuitry 38 are described in U.S. Pat. No. 6,701,138, entitled POWER AMPLIFIER CONTROL, issued Mar. 2, 2004, and U.S. Pat. No. 6,701,134, entitled INCREASED DYNAMIC RANGE FOR POWER AMPLIFIERS USED WITH POLAR MODULATION, issued Mar. 2, 2004, which are assigned to RF Micro Devices, Inc. of 7628 Thorndike Road, Greensboro, N.C. 27409 and are hereby incorporated by reference in their entireties. Other exemplary embodiments of the power amplifier circuitry 36 and the power control circuitry 38 are described in U.S. patent application Ser. No. 10/920,073, POWER AMPLIFIER CONTROL USING A SWITCHING POWER SUPPLY, filed Aug. 17, 2004, which is hereby incorporated by reference it its entirety.

Figure 2:
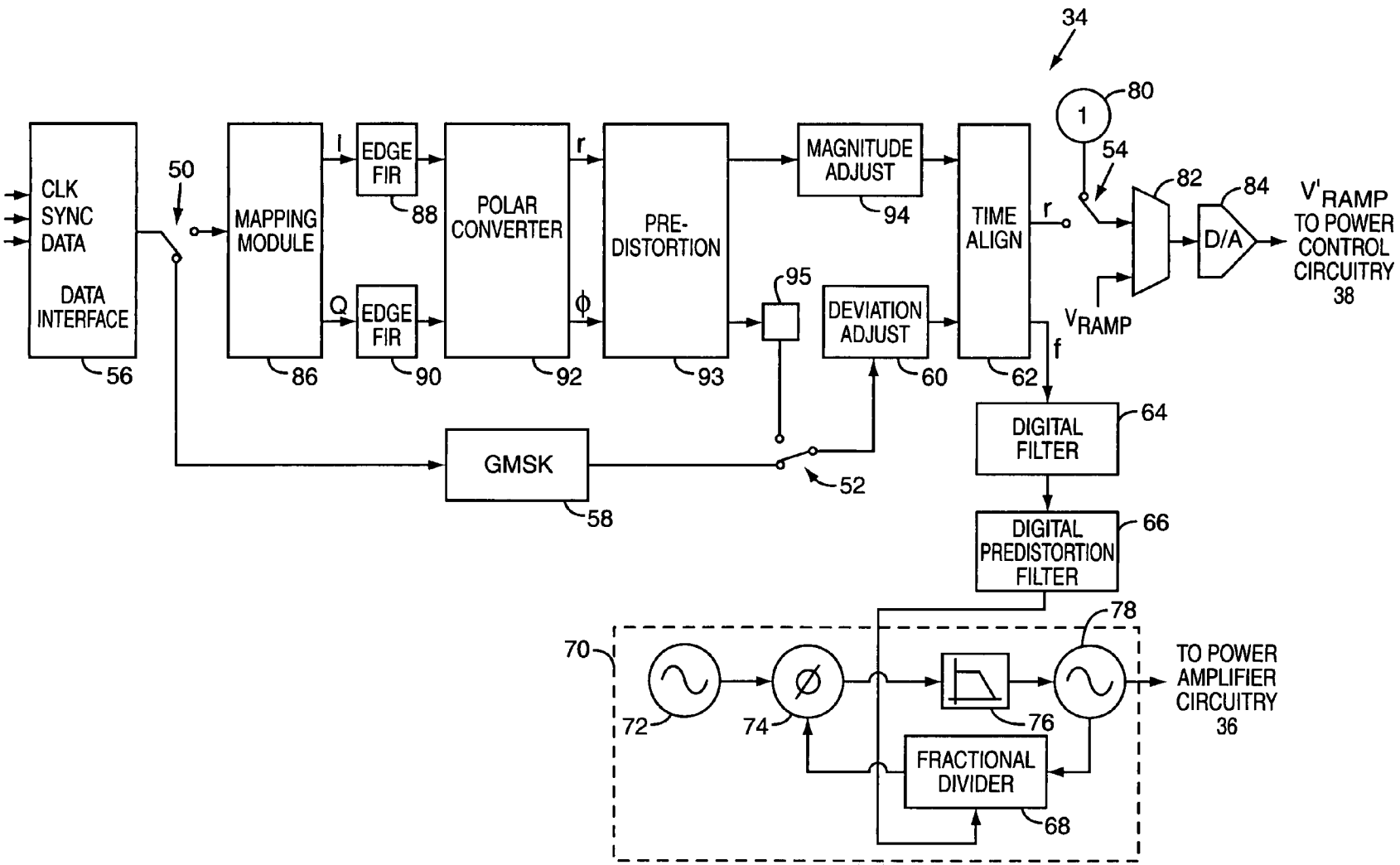
FIG. 2 is an exemplary embodiment of the modulator of the mobile terminal of FIG. 1 which operates in either a Gaussian Minimum Shift Keying (GMSK) mode or an Enhanced Data Rate for Global Evolution (EDGE) mode.

FIG. 2 illustrates an exemplary embodiment of the modulator 34, where the modulator 34 may switch between 8-Level Phase Shift Keying (8PSK) and Gaussian Minimum-Shift Keying (GMSK) modes. The 8PSK mode is also referred to herein as an Enhanced Data Rate for Global Evolution (EDGE) mode. Switches 50, 52, and 54 operate in tandem to switch the modulator between the two modes. As shown, the switches 50, 52, and 54 are such that the modulator 34 is in GMSK mode. As such, the data interface 56 receives data to be transmitted from the control system 22 (FIG. 1). The switch 50 is positioned to couple the output of the data interface 56 to GMSK processing circuitry 58. The GMSK processing circuitry 58 is conventional GMSK processing circuitry and operates to generate a frequency signal. Exemplary GMSK processing circuitry is discussed in U.S. Pat. No. 5,825,257, issued Oct. 20, 1998, and entitled "GMSK Modulator Formed of PLL to which Continuous Phase Modulated Signal is Applied," which is hereby incorporated by reference in its entirety. It should be appreciated that other GMSK processing circuitry may also be used and the particular circuitry is not central to the present invention. A frequency deviation of the frequency signal from the GMSK processing circuitry 58 is adjusted by deviation adjuster 60, and the adjusted frequency signal is time aligned with the amplitude component by time aligner 62.

The frequency signal (f) from the time aligner 62 is then filtered and predistorted by the digital filter 64 and the digital predistortion filter 66 before being introduced to fractional divider 68 of the fractional-N Phase-Locked Loop (PLL) 70. In addition to the fractional divider 68, the fractional-N PLL 70 includes a reference oscillator 72, a phase detector 74, a low-pass filter 76, and a voltage controlled oscillator 78. The output of the fractional-N PLL 70 is provided to the power amplifier circuitry 36 for amplification. The switch 54 is positioned such that the adjustable power control signal ($V_{RAMP}$) and a unity step function provided by unity step function generator 80 are combined by a multiplier 82. The output of the multiplier 82 is digitized by a digital-to-analog (D/A) converter 84 to generate the power control signal ($V'_{RAMP}$) provided to the power control circuitry 38.

For 8PSK mode, which for a GSM telephone may also be referred to as EDGE mode, the switches 50, 52, and 54 are switched in tandem such that the output of the data interface 56 is coupled to a mapping module 86, which generates a quadrature signal. The in-phase and quadrature components (I,Q) of the quadrature signal are filtered by filters 88 and 90 and provided to a polar converter 92. The polar converter 92 operates to convert the in-phase and quadrature components (I,Q) of the quadrature signal into polar coordinates (r,ϕ) of a polar signal. Predistortion circuitry 93 operates to predistort the amplitude component (r) and/or the phase component (ϕ) of the polar signal (r,ϕ) to compensate for Amplitude Modulation to Amplitude Modulation (AM/AM) distortion and/or Amplitude Modulation to Phase Modulation (AM/PM) distortion caused by inherent characteristics of the power amplifier circuitry 36.

Exemplary embodiments of the predistortion circuitry 93 are described in commonly owned and assigned U.S. Patent Application Publication No. 2003/0215025, entitled AM TO PM CORRECTION SYSTEM FOR A POLAR MODULATOR, published Nov. 20, 2003; U.S. Patent Application Publication No. 2003/0215026, entitled AM TO AM CORRECTION SYSTEM FOR A POLAR MODULATOR, published Nov. 20, 2003; and U.S. patent application Ser. No. 10/859,718, entitled AM TO FM CORRECTION SYSTEM FOR A POLAR MODULATOR, filed Jun. 2, 2004, which are hereby incorporated by reference in their entireties.

For AM/AM predistortion, the predistortion circuitry 93 operates to add a compensation signal to the amplitude component (r) from the polar converter 92, where the compensation signal compensates for the AM/AM distortion of the power amplifier circuitry 36 (FIG. 1). More specifically, in one embodiment, the compensation signal ($r_{COMP}$) for AM/AM predistortion is provided according to the following equation:

$$r_{COMP}(t)=SQAN\cdot r^3(t)+SQAP\cdot r^2(t),$$

where SQAN is the cubic coefficient and SQAP is the square coefficient. Thus, after ramp-up for a transmit burst, the combined signal provided to the D/A converter 84 may be defined as:

$$V'_{RAMP}(t)=[SQAN\cdot r^3(t)+SQAP\cdot r^2(t)+r(t)]*PAG+SQOFSA,$$

where PAG is the power amplifier gain setting (PAG) that is combined with a ramping signal defining the transmit burst to provide $V_{RAMP}$, and SQOFSA is a DC offset term that may be added to the combined signal provided by the multiplier 82 before digitization by the D/A converter 84. The equation above for $V'_{RAMP}$ may also be said to define the transfer function of the circuitry between the polar converter 92 and the D/A converter 84. Together, the coefficients SQAN, SQAP, PAG, and SQOFSA are referred to herein as AM/AM predistortion coefficients.

For AM/PM predistortion, the predistortion circuitry 93 operates to subtract a compensation signal from the phase component (ϕ) from the polar converter 92. More specifically, the compensation signal ($\phi_{COMP}$) is provided based on the following equation:

$$\phi_{COMP}(t)=\sum_{i=0}^{M} C_i(r(n))^i$$

As an example, if M=3, the equation expands to the following:

$$\phi_{COMP}(t)=CUP\cdot r^3(t)+SQP\cdot r^2(t)+LNP\cdot r(t),$$

where CUP is the cubic coefficient, SQP is the square coefficient, and LNP is the linear coefficient.

The magnitude of the amplitude component (r) of the polar signal is adjusted by magnitude adjuster 94. The phase component (ϕ) is converted to a frequency signal by phase to frequency converter 95, and the frequency deviation of the frequency signal is adjusted by the deviation adjuster 60. The amplitude component (r) and the adjusted frequency signal are time aligned by the time aligner 62. Thereafter, amplitude component (r) and the frequency signal (f) separate and proceed by different paths, an amplitude signal processing path and a frequency signal processing path, respectively, to the power amplifier circuitry 36.

With respect to the amplitude signal processing path, the switch 54 is positioned such that the amplitude component (r) is combined with the adjustable power control signal ($V_{RAMP}$) by the multiplier 82. The combined signal is then converted to an analog signal by the D/A converter 84 to provide the power control signal ($V'_{RAMP}$) to the power control circuitry 38. It should be noted that in EDGE mode, the power control signal ($V'_{RAMP}$) provided to the power control circuitry 38 operates to set the output power of the power amplifier circuitry 36 and to provide amplitude modulation.

The frequency signal (f) is digitally low pass filtered by digital filter 64 and then predistorted by digital predistortion filter 66 before being provided to the fractional-N PLL 70. The digital predistortion filter 66 has approximately the inverse of the transfer function of the PLL 70. For more information about the digital predistortion filter 66, the interested reader is referred to U.S. Pat. No. 6,008,703, entitled "Digital Compensation for Wideband Modulation of a Phase Locked Loop Frequency Synthesizer," issued Dec. 28, 1999, which is hereby incorporated by reference in its entirety. The output of the PLL 70 is a frequency modulated signal at the RF carrier, which in turn is applied as the signal input of the power amplifier circuitry 36.

The present invention provides a method of calibrating an output power of the mobile terminal 10 (FIG. 1) using a N-th order curve fit to define a power amplifier gain (PAG) versus desired RF output voltage characteristic of the power amplifier circuitry 36. The desired RF output voltage is indicative of a desired output power and defined as:

$$V_{DESIRED}=\sqrt{\frac{10^{\frac{P_{DESIRED}}{10}}}{20}}=\frac{1}{\sqrt{20}}\times 10^{\frac{P_{DESIRED}}{20}},$$

where $V_{DESIRED}$ is the desired RF output voltage and $P_{DESIRED}$ is the desired output power. It should be noted that, in the past, the power amplifier gain (PAG) versus desired output power characteristic of a power amplifier was assumed to be linear and thus defined using a first order curve fit. However, the power amplifier gain (PAG) versus desired output power characteristic of a power amplifier is not perfectly linearly. Accordingly, a first order curve fit introduces errors in output power accuracy.

Figure 3:
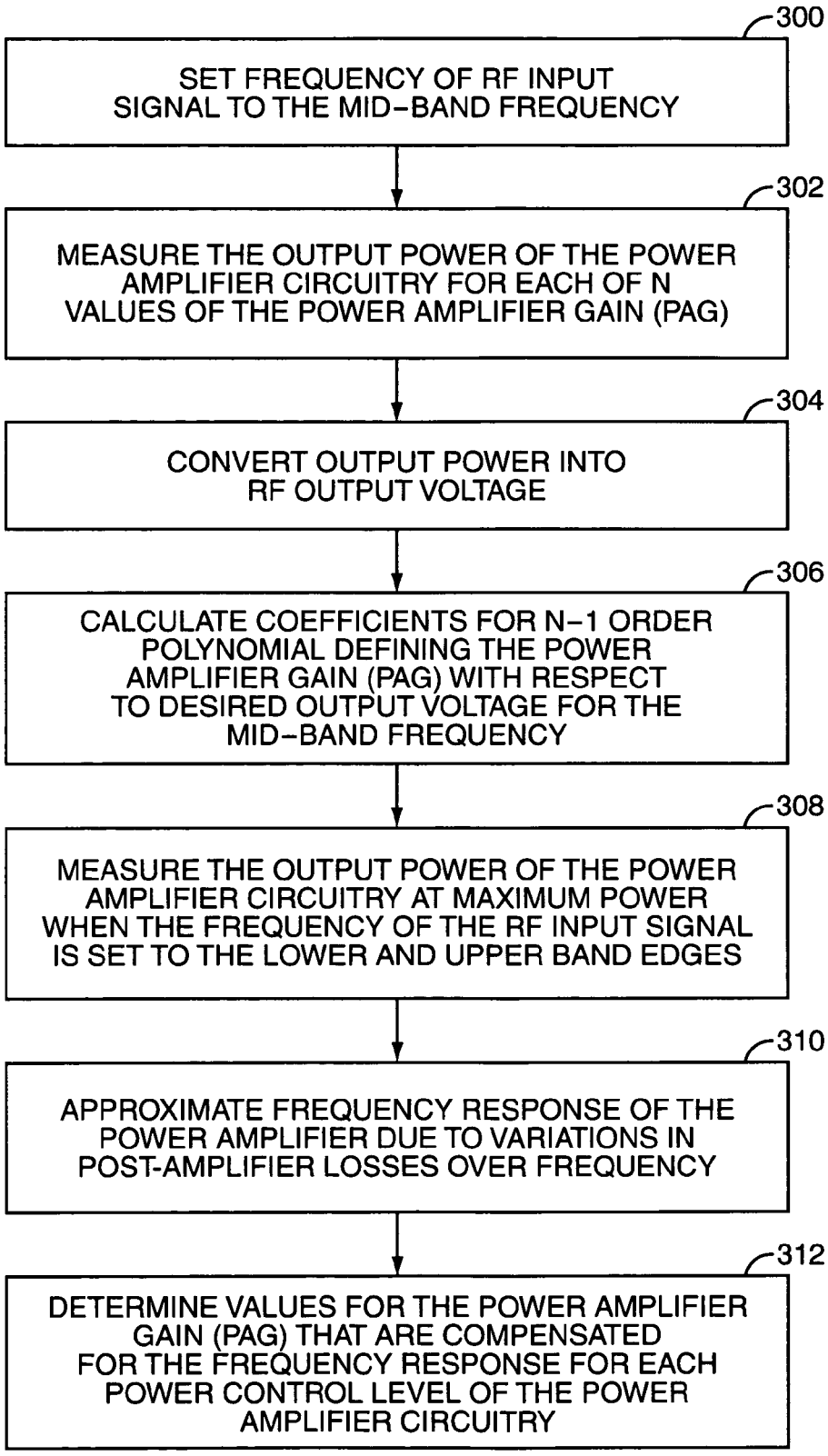
FIG. 3 illustrates a method of calibrating the output power of the mobile terminal of FIGS. 1 and 2 for GMSK mode according to one embodiment of the present invention.

FIG. 3 illustrates a first method of calibrating the output power of the mobile terminal 10 for each output power level. As an exemplary embodiment, the method of FIG. 3 is described wherein the mobile terminal 10 is a GSM mobile telephone operating in either GMSK mode or 8PSK mode. The 8PSK mode may also be referred to as EDGE mode. The mobile terminal 10 may also operate in one or more of the GSM850 frequency band, the Extended GSM (EGSM) frequency band, the Digital Cellular Service (DCS) frequency band, and the Personal Communications Service (PCS) frequency band. However, it should be noted that nothing in this disclosure is meant to limit the present invention to a GSM mobile telephone.

First, the mobile terminal 10 is configured to transmit GMSK bursts and the frequency of the RF input signal is set to a mid-band frequency (step 300). The mid-band frequency is equal to or approximately equal to a center frequency of a desired frequency band of the mobile terminal 10. For example, if the mobile terminal 10 is a GSM mobile telephone and the desired frequency band is the GSM850 frequency band (824.2 MHz-848.8 MHz), then the mid-band frequency may be 836.4 MHz. Next, an output power of the power amplifier circuitry 36 is measured for each of N values for the power amplifier gain (PAG), where N is an integer greater than two (step 302). The measurements of the output power are converted into radio frequency output voltages using the equation:

$$V = \sqrt{\frac{10^{\frac{P}{10}}}{20}} = \frac{1}{\sqrt{20}} \times 10^{\frac{P}{20}},$$

where V is RF output voltage and P is output power (step 304). Using the RF output voltage values and the corresponding values for the power amplifier gain (PAG), a system of equations is solved to calculate coefficients defining a N−1 order polynomial describing the power amplifier gain (PAG) as a function of the desired output voltage ($V_{DESIRED}$) for the mid-band frequency (step 306). More particularly, the system of equations may be defined as:

$$\begin{vmatrix} C_{N-1} \\ \vdots \\ C_1 \\ C_0 \end{vmatrix} = \begin{vmatrix} V_1^{N-1} & \dots & V_1 & 1 \\ V_2^{N-1} & \dots & V_2 & 1 \\ \vdots & \dots & \vdots & \vdots \\ V_N^{N-1} & \dots & V_N & 1 \end{vmatrix} \times \begin{vmatrix} PAG_1 \\ PAG_2 \\ \vdots \\ PAG_N \end{vmatrix}.$$

Solving the system of equations yields the coefficients ($C_0 \dots C_{N-1}$), which define the polynomial:

$$PAG_{MID\text{-}BAND} = C_0 + C_1 V_{DESIRED} + C_2 V_{DESIRED}^2 + \dots.$$

The polynomial for $PAG_{MID\text{-}BAND}$ accurately describes the power amplifier gain (PAG) as long as the frequency of the RF input signal is essentially equal to the mid-band frequency. As the frequency of the RF input signal changes from the mid-band frequency to some other frequency within the desired frequency band, the accuracy of the polynomial for $PAG_{MID\text{-}BAND}$ decreases. This decrease in accuracy is due to the fact that post-amplifier losses are dependent on frequency. The post-amplifier losses are losses seen at the output of the power amplifier circuitry 36 and include losses associated with the antenna 16. Thus, for the same value of the power amplifier gain (PAG), the output power of the power amplifier circuitry 36 varies as the frequency of the RF input signal varies.

In order to accurately describe the power amplifier gain (PAG) for all frequencies within the desired frequency band, the method of FIG. 3 also includes steps for compensating for the variations in the output of the power amplifier circuitry 36 due to variations in the post-amplifier losses over frequency. More particularly, in this embodiment, the PAG is set such that the power amplifier circuitry 36 is set to a maximum output power via the adjustable power control signal ($V_{RAMP}$), and the output power is first measured when the frequency of the RF input signal is set to a frequency ($f_H$) at an upper edge of the desired frequency band, and is also measured when the frequency of the RF input signal is set to a frequency ($f_L$) at a lower edge of the desired frequency band (step 308).

The measured output powers are converted to RF voltages $V_H$ and $V_L$, respectively, using the equation given above. Then, the frequency response of the RF output voltage of the power amplifier circuitry 36 is approximated using the RF voltages $V_H$ and $V_L$ (step 310). In this embodiment, the frequency response is approximated using two interpolations and is defined as:

$$f < f_C : V(f) = \left(\frac{V_C - V_L}{f_C - f_L}\right) \cdot f + V_C - \left(\frac{V_C - V_L}{f_C - f_L}\right) \cdot f_C$$

$$f > f_C : V(f) = \left(\frac{V_C - V_H}{f_C - f_H}\right) \cdot f + V_C - \left(\frac{V_C - V_H}{f_C - f_H}\right) \cdot f_C$$

where $f_C$ is the mid-band frequency, $V_C$ is the RF output voltage when the frequency of the RF input signal is the mid-band frequency ($f_C$) and the power control circuitry 36 is set to a maximum output power level via the power amplifier gain (PAG), and f is a frequency of the RF input signal. It should be noted that $V_C$ may either be calculated using the polynomial for $PAG_{MID\text{-}BAND}$ given above or may be one of the RF output voltages from step 304.

Using the equation for the frequency response, V(f) can be calculated for any frequency f in the desired frequency band. To compensate for the frequency response, the desired output voltage is defined as:

$$V_{DESIRED} = V_{TARGET} \times \left(\frac{V_C}{V(f)}\right),$$

where $V_{TARGET}$ is the RF output voltage needed when the post-amplifier losses are 50Ω to achieve the desired output power and $V_{DESIRED}$ is the desired RF output voltage that is corrected to compensate for the variations in the post-amplifier losses over frequency. It should be noted that when the desired frequency is $f_C$, V(f) is equal to $V_C$ such that $V_{DESIRED}$ is equal to $V_{TARGET}$. Using the equations above for $PAG_{MID\text{-}BAND}$, V(f), and $V_{DESIRED}$, values for the power amplifier gain (PAG) are determined for each output power level for each desired frequency in the desired frequency band (step 312).

FIGS. 4A and 4B illustrate a second method of calibrating the output power of the mobile terminal 10. This embodiment is similar to that in FIG. 3. Again, as an exemplary embodiment, the mobile terminal 10 is a GSM mobile telephone operating in either GMSK mode or 8PSK mode and in one or more of the GSM850 frequency band, the EGSM frequency band, the DCS frequency band, and the PCS frequency band. First, the frequency of the RF input signal is set to a mid-band frequency (step 400). The mid-band frequency is equal to or approximately equal to a center frequency of a desired frequency band of the mobile terminal 10. For example, if the mobile terminal 10 is a GSM mobile telephone and the desired frequency band is the GSM850 frequency band, then the mid-band frequency is approximately 836.4 MHz.

Next, an output power of the power amplifier circuitry 36 is measured for each of N values for the power amplifier gain (PAG), where N is an integer greater than two (step 402). The measurements of the output power are converted into radio frequency output voltages using the equation:

$$V = \sqrt{\frac{10^{\frac{P}{10}}}{20}} = -\frac{1}{\sqrt{20}} \times 10^{\frac{P}{20}},$$

where V is RF output voltage and P is output power (step 404). Using the RF output voltage values and the corresponding values of the power amplifier gain (PAG), a system of equations is solved to calculate coefficients defining a N−1 order polynomial describing the power amplifier gain (PAG) as a function of the desired output voltage ($V_{DESIRED}$) for the mid-band frequency (step 406). More particularly, the system of equations may be defined as:

$$\begin{vmatrix} C_{N-1,M} \\ \vdots \\ C_{1,M} \\ C_{0,M} \end{vmatrix} = \begin{vmatrix} V_{1,M}^{N-1} & \dots & V_{1,M} & 1 \\ V_{2,M}^{N-1} & \dots & V_{2,M} & 1 \\ \vdots & \dots & \vdots & \vdots \\ V_{N,M}^{N-1} & \dots & V_{N,M} & 1 \end{vmatrix} \times \begin{vmatrix} PAG_{1,M} \\ PAG_{2,M} \\ \vdots \\ PAG_{N,M} \end{vmatrix}.$$

Solving the system of equations yields the coefficients ($C_{0,M} \dots C_{N-1,M}$), which define the polynomial:

$$PAG_M = C_{0,M} + C_{1,M} V_{DESIRED} + C_{2,M} V_{DESIRED}^2 + \dots.$$

The polynomial for $PAG_M$ accurately describes the power amplifier gain (PAG) as long as the frequency of the RF input signal is the mid-band frequency. As the frequency of the RF input signal changes from the mid-band frequency to some other frequency within the desired frequency band, the accuracy of the polynomial for $PAG_{MID\text{-}BAND}$ decreases. This decrease in accuracy is due to the fact that post-amplifier losses are dependent on frequency. The post-amplifier losses are losses seen at the output of the power amplifier circuitry 36 and include losses associated with the antenna 16. Thus, for the same value of the power amplifier gain (PAG), the output power of the power amplifier circuitry 36 varies as the frequency of the RF input signal varies.

Steps 408-424 are performed to accurately describe the power amplifier gain (PAG) for all frequencies in the desired frequency band. In order to do so, the frequency of the RF input signal is set to an upper-band frequency ($f_H$), which is a frequency at or near an upper edge of the desired frequency band (step 408). For example, if the desired frequency band is the GSM850 frequency band (824.2 MHz-848.8 MHz), then the upper-band frequency may be 844.8 MHz.

Next, an output power of the power amplifier circuitry 36 is measured for each of N values of the power amplifier gain (PAG), where N is an integer greater than two (step 410). The N values of the power amplifier gain (PAG) may or may not be the same values as used in step 402. Further, the number N for steps 402 and 410 may or may not be the same number. The measurements of the output power are converted into radio frequency output voltages using the equation:

$$V = \sqrt{\frac{10^{\frac{P}{10}}}{20}} = \frac{1}{\sqrt{20}} \times 10^{\frac{P}{20}},$$

where V is RF output voltage and P is output power (step 412). Using the RF output voltage values and the corresponding values of the power amplifier gain (PAG), a system of equations is solved to calculate coefficients defining a N−1 order polynomial describing the power amplifier gain (PAG) as a function of the desired output voltage ($V_{DESIRED}$) for the upper-band frequency (step 414). More particularly, the system of equations may be defined as:

$$\begin{vmatrix} C_{N-1,H} \\ \vdots \\ C_{1,H} \\ C_{0,H} \end{vmatrix} = \begin{vmatrix} V_{1,H}^{N-1} & \dots & V_{1,H} & 1 \\ V_{2,H}^{N-1} & \dots & V_{2,H} & 1 \\ \vdots & \dots & \vdots & \vdots \\ V_{N,H}^{N-1} & \dots & V_{N,H} & 1 \end{vmatrix} \times \begin{vmatrix} PAG_{1,H} \\ PAG_{2,H} \\ \vdots \\ PAG_{N,H} \end{vmatrix}.$$

Solving the system of equations yields the coefficients ($C_{0,H} \dots C_{N-1,H}$), which define the polynomial:

$$PAG_H = C_{0,H} + C_{1,H} V_{DESIRED} + C_{2,H} V_{DESIRED}^2 + \dots,$$

where the equation for $PAG_H$ accurately describes the power amplifier gain (PAG) when the RF input signal is at the upper-band frequency.

Next, as shown in FIG. 4B, the frequency of the RF input signal is set to a lower-band frequency ($f_L$), which is a frequency at or near a lower edge of the desired frequency band (step 416). For example, if the desired frequency band is the GSM850 frequency band (824.2 MHz-848.8 MHz), then the lower-band frequency may be 828.2 MHz. An output power of the power amplifier circuitry 36 then is measured for each of N values of the power amplifier gain (PAG), where N is an integer greater than two (step 418). The N values of the power amplifier gain (PAG) may or may not be the same values used in steps 402 and 410. Further, the number N for steps 402, 410, and 418 may or may not be the same number. The measurements of the output power are converted into radio frequency output voltages using the equation:

$$V = \sqrt{\frac{10^{\frac{P}{10}}}{20}} = \frac{1}{\sqrt{20}} \times 10^{\frac{P}{20}},$$

where V is RF output voltage and P is output power (step 420). Using the RF output voltage values and the corresponding values of the power amplifier gain (PAG), a system of equations is solved to calculate coefficients defining a N−1 order polynomial describing the power amplifier gain (PAG) as a function of the desired output voltage ($V_{DESIRED}$) for the lower-band frequency (step 422). More particularly, the system of equations may be defined as:

$$\begin{vmatrix} C_{N-1,L} \\ \vdots \\ C_{1,L} \\ C_{0,L} \end{vmatrix} = \begin{vmatrix} V_{1,L}^{N-1} & \dots & V_{1,L} & 1 \\ V_{2,L}^{N-1} & \dots & V_{2,L} & 1 \\ \vdots & \dots & \vdots & \vdots \\ V_{N,L}^{N-1} & \dots & V_{N,L} & 1 \end{vmatrix} \times \begin{vmatrix} PAG_{1,L} \\ PAG_{2,L} \\ \vdots \\ PAG_{N,L} \end{vmatrix}.$$

Solving the system of equations yields the coefficients ($C_{0,L} \dots C_{N-1,L}$), which define the polynomial:

$$PAG_L = C_{0,L} + C_{1,L} V_{DESIRED} + C_{2,L} V_{DESIRED}^2 + \dots,$$

where the equation for $PAG_L$ accurately describes the power amplifier gain (PAG) when the RF input signal is at the lower-band frequency.

Once the coefficients defining the polynomials describing $PAG_L$, $PAG_M$, and $PAG_H$ are determined, values of the power amplifier gain (PAG) that are compensated for variations in post-amplifier losses over frequency are calculated for desired power control levels (step 424). In one embodiment, the values of the power amplifier gain (PAG) are calculated for each of the sub-bands of the desired frequency band using the three equations for $PAG_L$, $PAG_M$, and $PAG_H$ given above. For each frequency in the lower sub-band, the values for $PAG_L$ are used. For each frequency in the mid sub-band, the values for $PAG_M$ are used. For each frequency in the upper sub-band, the values for $PAG_H$ are used.

In another embodiment, an interpolation is performed to correct for the variations in the post-amplifier losses over frequency. The interpolation may be defined as:

$$f < f_M : PAG(f) = \left(\frac{PAG_M - PAG_L}{f_M - f_L}\right) \cdot f + PAG_M - \left(\frac{PAG_M - PAG_L}{f_M - f_L}\right) \cdot f_M$$

$$f > f_M : PAG(f) = \left(\frac{PAG_M - PAG_H}{f_M - f_H}\right) \cdot f + PAG_M - \left(\frac{PAG_M - PAG_H}{f_M - f_H}\right) \cdot f_M,$$

where f is the desired frequency of the RF input signal, $f_M$ is the mid-band frequency, $f_L$ is the lower-band frequency, and $f_H$ is the upper-band frequency. Thus, using these interpolations, values for the power amplifier gain (PAG) may be determined for any combination of desired output power level and desired frequency within the desired frequency band.

Referring to the method of FIGS. 4A and 4B, the upper-band frequency ($f_H$), the mid-band frequency ($f_M$), and the lower-band frequency ($f_L$) may be selected based on dividing the desired frequency band into three essentially equal sized ranges: a lower range, a middle range, and an upper range. The upper-band frequency ($f_H$) is a frequency essentially at the center of the upper range, the mid-band frequency ($f_M$) is a frequency essentially at the center of the middle range, and the lower-band frequency ($f_L$) is a frequency essentially at the center of the lower range. For example, if the desired frequency band is the GSM850 frequency band, then the lower range may be 824.2 MHz to 832.2 MHz such that the lower-band frequency is essentially 828.2 MHz. The middle range may be 832.4 MHz to 840.6 MHz such that the mid-band frequency is essentially 836.4 MHz. The upper range may be 840.8 MHz to 848.8 MHz such that the upper-band frequency is essentially 844.8 MHz.

It should also be noted that the method of FIG. 3 may also be used to calibrate the output power for multiple frequency bands. For example, the mobile terminal 10 may be a GSM telephone capable of operating in the GSM850 band, the EGSM band, the DCS band, and the PCS band. Thus, the output power of the mobile terminal 10 is calibrated for each frequency band. Referring back to FIG. 3, steps 300-312 may be repeated for each frequency band. Alternatively, steps 300 and 302 may be repeated for each frequency band prior to step 304. Then, in step 304, the measured output powers for each frequency band are converted to RF output voltages. Next, each of the steps 306, 308, and 310 are repeated for each frequency band. Finally, in step 312, the values of the power amplifier gain (PAG) that are compensated for variations in the post-amplifier losses over frequency are determined for each power control level of the power amplifier circuitry 36.

Likewise, the method of FIGS. 4A and 4B may also be used to calibrate the output power for multiple frequency bands. More specifically, steps 400-424 may be repeated for each frequency band. Alternatively, steps 400 and 402 may be repeated for each frequency band to obtain the mid-band measurements of the output power for each of the N values of the power amplifier gain (PAG) for each of the frequency bands prior to step 404. Then, in steps 404 and 406, the measured output powers for each frequency band are converted to RF output voltages, and the coefficients of the polynomials defining the power amplifier gain (PAG) for the mid-band frequency of each frequency band are calculated. Similarly, steps 408 and 410 may be repeated for each frequency band to obtain the upper-band measurements of the output power for each of the N values of the power amplifier gain (PAG) for each of the frequency bands prior to step 412.

Then, in steps 412 and 414, the measured output powers for each frequency band are converted to RF output voltages, and the coefficients of the polynomials defining the power amplifier gain (PAG) for the upper-band frequency of each frequency band are calculated. Steps 416 and 418 may be repeated for each frequency band to obtain the lower-band measurements of the output power for each of the N values of the power amplifier gain (PAG) for each of the frequency bands prior to step 420. Then, in steps 420 and 422, the measured output powers for each frequency band are converted to RF output voltages, and the coefficients of the polynomials defining the power amplifier gain (PAG) for the lower-band frequency of each frequency band are calculated. Finally, in step 424, the values of the power amplifier gain (PAG) that are compensated for variations in the post-amplifier losses over frequency are determined for each power control level within each frequency band of the power amplifier circuitry 36.

As described in previously incorporated U.S. Pat. No. 6,701,134 and U.S. patent application Ser. No. 10/920,073, entitled POWER AMPLIFIER CONTROL USING A SWITCHING POWER SUPPLY, filed Aug. 17, 2004, the power amplifier circuitry 36 may also be capable of operating in a high power mode and a low power mode. In order to accurately calibrate the output power, either of the methods of FIGS. 3, 4A, and 4B may be performed once while the power amplifier circuitry 36 is in high power mode and again while the power amplifier circuitry 36 is in low power mode.

FIGS. 5 and 6 illustrate a method of calibrating the AM/AM predistortion coefficients including an EDGE PAG value (PAG_E) based on the coefficients defining the polynomials for $PAG_L$, $PAG_M$, and $PAG_H$ determined during the GMSK calibration described above with respect to FIGS. 4A and 4B.

More specifically, FIG. 5 illustrates a method for calibrating a first reference mobile terminal 10 (500). First, the GMSK output power calibration procedure of FIGS. 4A and 4B is performed to provide the coefficients for the polynomials defining $PAG_H$, $PAG_M$, and $PAG_L$ for each desired output power level in each desired frequency band (step 502). Next, for a desired output power level, values for the power control signal ($V'_{RAMP}$) are computed for a number (M) of predetermined amplitude modulation points based on optimized AM/AM predistortion coefficients (step 504). More specifically, prior to calibration, an optimization procedure is performed to provide optimized values for the AM/AM predistortion coefficients including PAG for each desired output power level in each sub-band in the desired frequency bands. The optimized AM/AM predistortion-coefficients may be determined to optimize Output Radio Frequency Spectrum (ORFS) of the mobile terminal 10. The optimized AM/AM predistortion coefficients are used to compute values for the power control signal ($V'_{RAMP}$) for each of the number of predetermined amplitude modulation points. An exemplary optimization procedure is described in commonly owned and assigned U.S. patent application Ser. No. 11/151,022, entitled METHOD FOR OPTIMIZING AM/AM AND AM/PM PREDISTORTION IN A MOBILE TERMINAL, filed Jun. 13, 2005, which is hereby incorporated herein by reference in its entirety.

In one embodiment, there are four predetermined amplitude modulation points: a peak amplitude modulation point, an intermediate amplitude modulation point, an average amplitude modulation point, and a minimum amplitude modulation point. As used herein, the amplitude modulation points correspond to the amplitude component provided by the polar converter 92 (FIG. 2). As an exemplary embodiment, the four predetermined modulation points may be defined as:

Peak AM Point: $M1=2.3715\cdot10^{(-3.2+3.2)/20}$;

Intermediate AM Point: $M2=2.3715\cdot10^{(-3.2-8)/20}$;

Average AM Point: $M3=2.3715\cdot10^{(-3.2+0)/20}$; and

Minimum AM Point: $M4=2.3715\cdot10^{(-3.2-13.4)/20}$.

Using the four predetermined amplitude modulation points and the optimized AM/AM predistortion coefficients, four values of the power control signal ($V'_{RAMP}$) are computed. Using the exemplary equation for $V'_{RAMP}$ given above, the four values of the power control signal ($V'_{RAMP}$) may be computed as:

$$V'_{RAMP_M1}=[SQAN\cdot M1^3+SQAP\cdot M1^2+M1]*PAG+SQOFSA;$$

$$V'_{RAMP_M2}=[SQAN\cdot M2^3+SQAP\cdot M2^2+M2]*PAG+SQOFSA;$$

$$V'_{RAMP_M3}=[SQAN\cdot M3^3+SQAP\cdot M3^2+M3]*PAG+SQOFSA; \text{ and}$$

$$V'_{RAMP_M4}=[SQAN\cdot M4^3+SQAP\cdot M4^2+M4]*PAG+SQOFSA,$$

where SQAN, SQAP, PAG, and SQOFSA are the optimized AM/AM predistortion coefficients for the desired output power level, sub-band, and frequency band combination.

Next, the polynomial defining PAG for the desired output power level, sub-band, and frequency band combination is solved to compute values for $V_{DESIRED}$ for each of the predetermined amplitude modulation points (M1-M4) (step 506). More specifically, PAG may be defined as:

$$PAG=C_0+C_1V_{DESIRED}+C_2V_{DESIRED}^2+\ldots,$$

where $C_0$, $C_1$, $C_2$, . . . are the coefficients determined during the GMSK output power calibration of FIGS. 4A and 4B. In order to solve the equations, the values of the power control signal ($V'_{RAMP}$) determined in step 504 are substituted in this equation as the PAG value, and the equation is solved for $V_{DESIRED}$. For the exemplary embodiment, the following equations are solved to provide values of $V_{DESIRED}$ for each of the amplitude modulation points M1 through M4:

$$V'_{RAMP_M1}=C_0+C_1V_{DESIRED_M1}+C_2V_{DESIRED_M1}+\ldots;$$

$$V'_{RAMP_M2}=C_0+C_1V_{DESIRED_M2}+C_2V_{DESIRED_M2}^2+\ldots;$$

$$V'_{RAMP_M3}=C_0+C_1V_{DESIRED_M3}+C_2V_{DESIRED_M3}^2+\ldots; \text{ and}$$

$$V'_{RAMP_M4}=C_0+C_1V_{DESIRED_M4}+C_2V_{DESIRED_M4}+\ldots.$$

Next, the values for $V_{DESIRED}$ are converted to output power values (step 508). For example, the values $V_{DESIRED_M1}$ through $V_{DESIRED_M4}$ are converted to $P_{OUT_M1}$ through $P_{OUT_M4}$. Then, error values for each of the predetermined amplitude modulation points are computed defining a difference between the output power levels computed in step 508 and a target output power level (step 510). The target output power level is the average Root Mean Square (RMS) value of the output power for the desired output power level. For the exemplary embodiment, error values ($\epsilon_1$ through $\epsilon_4$) are computed for M1 through M4, respectively, according to the following equations:

$$\epsilon_1=P_{OUT_M1}-(\text{TARGET_}P_{OUT}+3.2);$$

$$\epsilon_2=P_{OUT_M2}-(\text{TARGET_}P_{OUT}-8);$$

$$\epsilon_3=P_{OUT_M3}-(\text{TARGET_}P_{OUT}+0); \text{ and}$$

$$\epsilon_4=P_{OUT_M4}-(\text{TARGET_}P_{OUT}-13.4),$$

where the TARGET_$P_{OUT}$+3.2 is the desired output power for M1, TARGET_$P_{OUT}$−8 is the desired output power for M2, TARGET_$P_{OUT}$+0 is the desired output power for M3, and TARGET_$P_{OUT}$−13.4 is the desired output power for M4.

Steps 504-510 may be repeated for each desired output power level, sub-band, and frequency band combination. The error values computed in step 510 need only to be computed once in the reference mobile terminal 10. The same error values can then be used for the calibration of any number of target mobile terminals 10 including the reference mobile terminal 10.

FIG. 6 illustrates a method 600 for calibrating the AM/AM predistortion coefficients for EDGE mode using the error values determined in step 510 of the method of FIG. 5. More specifically, the GMSK output power calibration procedure of FIGS. 4A and 4B is performed to determine the coefficients for the polynomials defining PAG for each output power level, sub-band, and frequency band combination (step 602). Note that, for the reference mobile terminal, step 602 need not be performed because GMSK output power calibration has already been performed (step 502, FIG. 5).

Next, for a desired target output power, corrected output power values are computed for each of the predetermined amplitude modulation points using the error values computed in step 510 (FIG. 5). For example, the corrected target output power values may be computed using the following equations:

$$\text{Corrected}P_{OUT_M1}=\text{TARGET}_P_{OUT}+3.2+\epsilon_1;$$

$$\text{Corrected}P_{OUT_M2}=\text{TARGET}_P_{OUT}-8+\epsilon_2;$$

$$\text{Corrected}P_{OUT_M3}=\text{TARGET}_P_{OUT}+0+\epsilon_3;\text{ and}$$

$$\text{Corrected}P_{OUT_M4}=\text{TARGET}_P_{OUT}-13.4+\epsilon_4.$$

The corrected target output power values are then converted to radio frequency (RF) voltage values (step 606). For example, Corrected$P_{OUT_M1}$ through Corrected$P_{OUT_M4}$ are converted to $V_{OUT_M1}$ through $V_{OUT_M4}$. Next, the polynomial defining PAG for the desired output power level, sub-band, and frequency band combination is used to compute a PAG value for each of the RF voltage values from step 606 (step 608). As such, PAG values are determined for the corrected output power values from step 604. For example, the RF voltages $V_{OUT_M1}$ through $V_{OUT_M4}$ may be substituted as the desired voltage ($V_{DESIRED}$) into the equation for PAG to provide:

$$\text{PAG}_{M1}=C_0+C_1V_{OUT_M1}+C_2V_{OUT_M1}^2+\ldots;$$

$$\text{PAG}_{M2}=C_0+C_1V_{OUT_M2}+C_2V_{OUT_M2}^2+\ldots;$$

$$\text{PAG}_{M3}=C_0+C_1V_{OUT_M3}+C_2V_{OUT_M3}^2+\ldots;\text{ and}$$

$$\text{PAG}_{M4}=C_0+C_1V_{OUT_M4}+C_2V_{OUT_M4}^2+\ldots,$$

where $C_0$, $C_1$, $C_2$, . . . are the coefficients determined for the desired output power level, sub-band, and frequency band combination during GMSK calibration.

Lastly, new AM/AM predistortion coefficients including an EDGE PAG value (PAG_E) are extracted using the known predetermined amplitude modulation points and the PAG values computed in step 608 (step 610). For example, by substituting the four amplitude modulation points and the PAG values $\text{PAG}_{M1}$ through $\text{PAG}_{M4}$ from step 608 into the equation for the power control signal ($V'_{RAMP}$), the following equations are obtained:

$$\text{PAG}_{M1}=[SQAN\cdot M1^3+SQAP\cdot M1^2+M1]\cdot\text{PAG}_E+SQOFSA;$$

$$\text{PAG}_{M2}=[SQAN\cdot M2^3+SQAP\cdot M2^2+M2]\cdot\text{PAG}_E+SQOFSA;$$

$$\text{PAG}_{M3}=[SQAN\cdot M3^3+SQAP\cdot M3^2+M3]\cdot\text{PAG}_E+SQOFSA;\text{ and}$$

$$\text{PAG}_{M4}=[SQAN\cdot M4^3+SQAP\cdot M4^2+M4]\cdot\text{PAG}_E+SQOFSA.$$

These four equations may be solved for new values of SQAN, SQAP, PAG_E, and SQOFSA. Note that the PAG values from step 608 are substituted as values of the power control signal ($V'_{RAMP}$).

Alternatively, the new values of SQAN, SQAP, PAG_E, and SQOFSA, which are the AM/AM predistortion coefficients, may be determined as follows:

$$a1_\text{coeff}=(\text{PAG}_{M3}-\text{PAG}_{M4})(M1^2-M2^2)-(\text{PAG}_{M1}-\text{PAG}_{M2})(M3^2-M4^2);$$

$$b1_\text{coeff}=(\text{PAG}_{M3}-\text{PAG}_{M4})(M1^3-M2^3)-(\text{PAG}_{M1}-\text{PAG}_{M2})(M3^3-M4^3);$$

$$c1_\text{coeff}=-(\text{PAG}_{M3}-\text{PAG}_{M4})(M1-M2)-(\text{PAG}_{M1}-\text{PAG}_{M2})(M3-M4);\text{ and}$$

$$a2_\text{coeff}=(\text{PAG}_{M2}-\text{PAG}_{M4})(M1^2-M3^2)-(\text{PAG}_{M1}-\text{PAG}_{M3})(M2^2-M4^2);$$

$$b2_\text{coeff}=(\text{PAG}_{M2}-\text{PAG}_{M4})(M1^3-M3^3)-(\text{PAG}_{M1}-\text{PAG}_{M3})(M2^3-M4^3);$$

$$c2_\text{coeff}=-(\text{PAG}_{M2}-\text{PAG}_{M4})(M1-M3)-(\text{PAG}_{M1}-\text{PAG}_{M3})(M2-M4).$$

SQAP and SQAN may then be computed as:

$$SQAP=\frac{(\text{c1_coeff}-(\text{b1_coeff/b2_coeff})\cdot\text{c2_coeff})}{(\text{a1_coeff}-(\text{b1_coeff/b2_coeff})\cdot\text{a2_coeff})};\text{ and}$$

$$SQAN=\frac{(\text{c1_coeff}-(\text{a1_coeff/a2_coeff})\cdot\text{c2_coeff})}{(\text{b1_coeff}-(\text{a1_coeff/a2_coeff})\cdot\text{b2_coeff})}.$$

The new values of SQAP and SQAN may then be used to solve for PAG_E and SQOFSA. More specifically, $$\text{PAG_E}=\frac{PAG_{M1}-PAG_{M4}}{\beta(M1+SQAP\cdot M1^2+SQAN\cdot M1^3)-\beta(M4+SQAP\cdot M4^2+SQAN\cdot M4^3)},$$

where β is a scaling factor of the modulator 34 (FIGS. 1 and 2), and $$SQOFSA=-(\text{PAG}_E\cdot\beta(M1+SQAP\cdot M1^2+SQAN\cdot M1^3)-\text{PAG}_{M1}).$$

This process may be repeated for each desired output power level, sub-band, and frequency band combination. In one embodiment, a set of values of the AM/AM predistortion coefficients are determined for a mid-band frequency, a lower-band frequency, and an upper-band frequency for each frequency band at each desired output power level. In another embodiment, steps 602-608 may be used to compute the PAG values for each of the predetermined amplitude modulation points for each of the upper band, mid-band, and lower band frequencies of a desired frequency band. An interpolation may be used to provide PAG values for any desired frequency in the frequency band. Then, using the interpolated PAG values, the new AM/AM predistortion coefficients may be extracted. The interpolation may be defined by the following equations:

$$f<f_M:PAG_{MX}(f)=\left(\frac{PAG_{\text{MX_M}}-PAG_{\text{MX_L}}}{f_M-f_L}\right)\cdot f+PAG_M-\left(\frac{PAG_{\text{MX_M}}-PAG_{\text{MX_L}}}{f_M-f_L}\right)\cdot f_M$$

$$f>f_M:PAG_{MX}(f)=\left(\frac{PAG_{\text{MX_M}}-PAG_{\text{MX_H}}}{f_M-f_H}\right)\cdot f+PAG_M-\left(\frac{PAG_{\text{MX_M}}-PAG_{\text{MX_H}}}{f_M-f_H}\right)\cdot f_M.$$

where f is the desired frequency of the RF input signal, $f_M$ is the mid-band frequency, $f_L$ is the lower-band frequency, and $f_H$ is the upper-band frequency. $PAG_{MX_M}$ is the one of the PAG values determined in step 608 for the mid-band frequency, $PAG_{MX_L}$ is one of the PAG values determined in step 608 for the lower-band frequency, and $PAG_{MX_H}$ is one of the PAG values determined in step 608 for the upper-band frequency. Using these interpolations, values for one of the power amplifier gains ($PAG_{MX}$) may be determined for any combination of desired output power level and desired frequency within the desired frequency band. Thereafter, the PAG values for the predetermined amplitude modulation points for any desired frequency may be used in step 610 to extract the new AM/AM predistortion coefficients.

FIG. 7 illustrates an output power calibration system including a calibration control system 96 and output power detection circuitry 98. The calibration control system 96 and the output power detection circuitry 98 operate to perform output power calibration for a first mode of operation of the mobile terminal 10 as described with respect to FIG. 3 and/or FIGS. 4A-4B. The calibration control system 96 and the output power calibration circuitry 98 may also operate to perform output power calibration of a second mode of operation of the mobile terminal 10 as described with respect to FIGS. 5 and 6.

For example, with respect to the method of FIGS. 4A and 4B, calibration control system 96 controls the mobile terminal 10 via communications with the control system 22 such that the frequency of the RF input signal is set to a mid-band frequency (step 400 of FIG. 4A). Next, an output power of the power amplifier circuitry 36 is measured by the output power detection circuitry 98 for each of N values for the power amplifier gain (PAG), where N is an integer greater than two (step 402 of FIG. 4A). The N measurements of the output power are communicated to the calibration control system 96. Based on the measurements of the output power, a system of equations is solved to calculate coefficients defining a N−1 order polynomial describing the power amplifier gain (PAG) as a function of the desired output voltage ($V_{DESIRED}$) for the mid-band frequency (step 406 of FIG. 4A). In a similar fashion, the calibration control system 96 and the output power detection circuitry 98 operate to perform steps 408-424 of FIGS. 4A and 4B to accurately describe the power amplifier gain (PAG) for all frequencies in the desired frequency band.

Although this example describes the calibration control system 96 and the output power detection circuitry 98 with respect to the output power calibration method of FIGS. 4A and 4B, it should be noted that the calibration control system 96 and the output power detection circuitry 98 may operate in a similar fashion to perform any one or combination of the methods of FIGS. 3-6. It should also be noted that the calibration control system 96 may be a computer system executing software that operates without intervention of an operator other than entering predetermined variables such as the number of output power measurements for each desired frequency band and possibly the frequency bands of interest. In another embodiment, the calibration control system 96 and possibly the output power detection circuitry 98 are operated by an operator. In this embodiment, the calibration control system 96 may again be a computer system executing software. However, in this embodiment, the calibration control system 96 may require intervention of the operator a various stages in the calibration process.

The present invention provides substantial opportunity for variation without departing from the spirit or scope of the present invention. For example, while the present invention is describe above with respect to the GMSK mode and 8PSK mode of the GSM standard, the present invention may be used to calibrate output power for mobile terminals operating according to various standards. For example, the GMSK mode may alternatively be any type of constant envelope modulation where there is no amplitude modulation. The 8PSK mode may alternatively be any polar modulation scheme where amplitude modulation is applied to the supply terminal of the power amplifier circuitry 36.

Those skilled in the art will recognize improvements and modifications to the preferred embodiments of the present invention. All such improvements and modifications are considered within the scope of the concepts disclosed herein and the claims that follow.

What is claimed is:

1. A method of calibrating an output power of a mobile terminal comprising:

a) providing a radio frequency (RF) input signal to an input of a power amplifier of the mobile terminal;

b) for each of an upper-band frequency, a mid-band frequency, and a lower-band frequency of a desired frequency band, measuring an output power of the mobile terminal for each of a plurality of values of an adjustable power amplifier gain (PAG), wherein the plurality of values of the PAG for each of the upper-band frequency, the mid-band frequency, and the lower-band frequency comprises at least three values;

c) for each of the upper-band frequency, the mid-band frequency, and the lower-band frequency of the desired frequency band, performing a curve fit for the plurality of values of the PAG and the corresponding plurality of measurements of the output power, thereby providing a plurality of coefficients defining a polynomial describing a PAG versus output power characteristic of the power amplifier; and d) determining values of the PAG corresponding to a plurality of desired output power levels and a plurality of frequencies within the desired frequency band based on the polynomials describing the PAG versus output power characteristic of the power amplifier for each of the upper-band, mid-band, and lower-band frequencies of the desired frequency band.

2. The method of claim 1 wherein for each of the plurality of desired output power levels, determining values of the PAG comprises determining values of the PAG for ones of the desired plurality of frequencies between the mid-band frequency and the upper-band frequency using an interpolation between a first value of the PAG for the desired output power level calculated using the polynomial describing the PAG versus output power characteristic for the upper-band frequency and a second value of the PAG for the desired output power level calculated using the polynomial describing the PAG versus output power characteristic for the mid-band frequency.

3. The method of claim 1 wherein for each of the plurality of desired output power levels, determining values of the PAG comprises determining values of the PAG for ones of the desired plurality of frequencies between the mid-band frequency and the lower-band frequency using an interpolation between a first value of the PAG for the desired output power level calculated using the polynomial describing the PAG versus output power characteristic for the mid-band frequency and a second value of the PAG for the desired output power level calculated using the polynomial describing the PAG versus output power characteristic for the lower-band frequency.

4. The method of claim 1 wherein providing the RF input signal, measuring the output power, performing the curve fit, and determining values of the PAG are repeated for each of a plurality of frequency bands.

5. The method of claim 1 wherein providing the RF input signal further comprises configuring the mobile terminal to be in a first mode of operation in which a supply voltage provided to the power amplifier comprises no amplitude modulation and the step of determining the values of the PAG determines the values of the PAG for the first mode of operation.

6. The method of claim 5 wherein the first mode of operation is a Gaussian Minimum Shift Keying (GMSK) mode of operation.

7. The method of claim 5 further comprising determining second values of the PAG for a second mode of operation for a plurality of target output power levels based on the polynomials describing the PAG versus output power characteristic of the power amplifier for each of the upper-band, mid-band, and lower-band frequencies of the desired frequency band, wherein the supply voltage provided to the power amplifier comprises amplitude modulation when operating in the second mode of operation.

8. The method of claim 7 wherein the second mode of operation is an Enhanced Data Rate for Global Evolution (EDGE) mode of operation.

9. The method of claim 7 wherein determining the second values of the PAG for the second mode of operation comprises for one of the plurality of target output power levels and one of the plurality of frequencies within the desired frequency band for the second mode of operation:

determining a corrected target output power value for each of a plurality of amplitude modulation points by combining desired output power values for the amplitude modulation points at the target output power and predetermined error values;

determining PAG values for each of the plurality of amplitude modulation points based on the corrected target output power values and the plurality of coefficients defining the polynomial describing the PAG versus output power characteristic of the power amplifier for the one of the plurality of frequencies; and computing Amplitude Modulation to Amplitude Modulation (AM/AM) predistortion coefficients including one of the second values of the PAG for the second mode of operation based on the plurality of amplitude modulation points and the PAG values for each of the plurality of amplitude modulation points.

10. The method of claim 9 wherein determining values of the PAG for the second mode of operation further comprises determining the error values in a reference mobile terminal.

11. The method of claim 10 wherein determining the error values in the reference mobile terminal comprises for the one of the plurality of target output power levels and the one of the plurality of frequencies within the desired frequency band:

determining values of a power control signal controlling an output power of the power amplifier for each of a plurality of amplitude modulation points based on the plurality of amplitude modulation points and an optimized set of Amplitude Modulation to Amplitude Modulation (AM/AM) predistortion coefficients defining a polynomial describing the power control signal as a function of amplitude modulation;

determining a value for the output power for each of the plurality of amplitude modulation points based on the values of the power control signal and a plurality of coefficients defining the polynomial describing a PAG versus output power characteristic of a power amplifier of the reference mobile terminal for the one of the plurality of frequencies; and for each of the plurality of amplitude modulation points, determining one of the error values based on a difference between the value of the output power for the amplitude modulation point and a desired output power for the amplitude modulation point.

12. A method of calibrating an output power of a mobile terminal comprising:

a) providing an RF input signal to an input of a power amplifier of the mobile terminal;

b) for a mid-band frequency of a desired frequency band, measuring an output power of the mobile terminal for each of a plurality of values of an adjustable power amplifier gain (PAG), wherein the plurality of values of the PAG comprises at least three values; and c) performing a curve fit for the plurality of values of the PAG and the corresponding plurality of measurements of the output power, thereby calculating a plurality of coefficients defining a polynomial describing a PAG versus output power characteristic of the power amplifier.

13. The method of claim 12 further comprising:

for each of a upper-band frequency and a lower-band frequency of the desired frequency band, measuring the output power of the mobile terminal for a predetermined value of the PAG to provide an upper-band and a lower-band frequency measurement of the output power; and determining values of the PAG corresponding to a plurality of desired output power levels and a plurality of frequencies within the desired frequency band based on the polynomial describing the PAG versus output power characteristic of the power amplifier for the mid-band frequency of the desired frequency band and the upper-band and lower-band frequency measurements of the output power such that the values of the PAG are compensated for variations in power-amplifier losses over frequency.

14. The method of claim 13 wherein for each of the plurality of desired output power levels, determining values of the PAG comprises:

converting the desired output power level to a desired RF voltage and the upper-band and lower-band frequency measurements to upper-band and lower-band RF voltages;

for ones of the plurality of frequencies greater than the mid-band frequency, calculating a desired RF voltage indicative of the desired output power level based on a first interpolation between a first point defined by the upper-band frequency and the upper-band RF voltage and a second point defined by the mid-band frequency and a mid-band RF voltage indicative of the output power of the mobile terminal corresponding to the predetermined value of the PAG;

for ones of the plurality of frequencies less than the mid-band frequency, calculating a desired RF voltage indicative of the desired output power level based on a second interpolation between a third point defined by the lower-band frequency and the lower-band RF voltage and the second point defined by the mid-band frequency and the mid-band RF voltage; and calculating the value of the PAG based on the desired RF voltage indicative of the desired output power level.

15. The method of claim 13 wherein providing the RF input signal, measuring the output power of the mobile terminal for each of a plurality of values of the PAG, performing a curve fit, measuring the output power of the mobile terminal for a predetermined value of the PAG to provide an upper-band and a lower-band frequency measurement of the output power, and determining values of the PAG are repeated for each of a plurality of frequency bands.

16. A system for calibrating an output power of a mobile terminal comprising:

a) output power detection circuitry adapted to measure the output power of the mobile terminal; and b) a calibration control system that calibrates the output power of the mobile terminal for a desired frequency band, the calibration control system adapted to:

i) control the mobile terminal such that an RF input signal is provided to an input of a power amplifier of the mobile terminal;

ii) for each of an upper-band frequency, a mid-band frequency, and a lower-band frequency of the desired frequency band, receive measurements of the output power of the mobile terminal from the output power detection circuitry for each of a plurality of values of an adjustable power amplifier gain (PAG), wherein the plurality of values of the PAG for each of the upper-band frequency, the mid-band frequency, and the lower-band frequency comprises at least three values;

iii) for each of the upper-band frequency, the mid-band frequency, and the lower-band frequency of the desired frequency band, perform a curve fit for the plurality of values of the PAG and the corresponding plurality of measurements of the output power, thereby providing a plurality of coefficients defining a polynomial describing a PAG versus output power characteristic of the power amplifier; and iv) determine values of the PAG corresponding to a plurality of desired output power levels and a plurality of frequencies within the desired frequency band based on the polynomials describing the PAG versus output power characteristic of the power amplifier for each of the upper-band, mid-band, and lower-band frequencies of the desired frequency band.

17. The system of claim 16 wherein for each of the plurality of desired output power levels, the calibration control system is further adapted to determine the values of the PAG by determining values of the PAG for ones of the desired plurality of frequencies between the mid-band frequency and the upper-band frequency using an interpolation between a first value of the PAG for the desired output power level calculated using the polynomial describing the PAG versus output power characteristic for the upper-band frequency and a second value of the PAG for the desired output power level calculated using the polynomial describing the PAG versus output power characteristic for the mid-band frequency.

18. The system of claim 16 wherein for each of the plurality of desired output power levels, the calibration control system is further adapted to determine values of the PAG by determining values of the PAG for ones of the desired plurality of frequencies between the mid-band frequency and the lower-band frequency using an interpolation between a first value of the PAG for the desired output power level calculated using the polynomial describing the PAG versus output power characteristic for the mid-band frequency and a second value of the PAG for the desired output power level calculated using the polynomial describing the PAG versus output power characteristic for the lower-band frequency.

19. The system of claim 16 wherein the calibration control system is further adapted to calibrate the output power of the mobile terminal for each of a plurality of desired frequency bands.

20. The system of claim 16 wherein the calibration control system is further adapted to configure the mobile terminal to be in a first mode of operation in which a supply voltage provided to the power amplifier comprises no amplitude modulation and the step of determining the values of the PAG determines the values of the PAG for the first mode of operation.

21. The system of claim 20 wherein the calibration control system is further adapted to determine second values of the PAG for a second mode of operation for a plurality of target output power levels and a second plurality of desired frequencies within a desired frequency band based on the polynomials describing the PAG versus output power characteristic of the power amplifier for each of the upper-band, mid-band, and lower-band frequencies of the desired frequency band, wherein the supply voltage provided to the power amplifier comprises amplitude modulation when operating in the second mode of operation.

* * * * *